US006018824A

United States Patent [19]

Pearson

[11] Patent Number: 6,018,824

[45] Date of Patent: Feb. 1, 2000

[54] VENTILATOR FOR TOILET FIXTURES

[76] Inventor: Raymond H. Pearson, 627 Sherwood Dr., Richardson, Tex. 75080-6124

[21] Appl. No.: 09/291,527

[22] Filed: Apr. 14, 1999

Related U.S. Application Data

[63] Continuation-in-part of application No. 09/001,948, Dec. 31, 1997, abandoned.

[51] Int. Cl.[7] ..... E03D 9/04

[52] U.S. Cl. ..... 4/213; 4/209 R

[58] Field of Search ..... 4/213, 209 R, 4/214, 215, 218

[56] References Cited

U.S. PATENT DOCUMENTS

| | | | |
|---|---|---|---|
| 2,221,940 | 11/1940 | Burrows | 4/213 |
| 2,974,323 | 3/1961 | Nofsinger | 4/213 |
| 3,689,944 | 9/1972 | Clayton | 4/213 |
| 4,117,559 | 10/1978 | Boyle | 4/209 R |
| 5,161,262 | 11/1992 | Quaintance, Sr. | 4/213 |
| 5,491,847 | 2/1996 | Shaffer | 4/213 |

*Primary Examiner*—David J. Walczak

[57] ABSTRACT

A ventilator for use with a toilet has a motor driven fan and an air freshener disposed in seriatim in the customary narrow gap between a raised closet seat and a flush tank, for inducing vitiated air from a closet bowl, and discharging freshened air into the ambient atmosphere. A thin housing, supporting a fan and an air freshener, is attached to the front of the flush tank, behind the raised seat. The large height, width, area and volume, of the gap behind the raised seat, accommodates a large canister, fan, air freshener, and battery to energize the fan motor. The ventilator is relatively unobtrusive for a large ventilator, and often hidden by the raised lid.

5 Claims, 2 Drawing Sheets

VENTILATOR FOR TOILET FIXTURES

CROSS REFERENCE TO RELATED APPLICATION

This application is a continuation-in-part of my application Ser. No. 09/001,948 filed Dec. 31, 1997 entitled VENTILATOR FOR TOILET FIXTURES, now abandoned.

BACKGROUND

1. Field of the Invention

The present invention relates generally to closet ventilators for toilet fixtures, and, more particularly, to ventilators of the type having a motor driven fan in seriatim with an air fresher, and disposed in a gap between a closet seat and a flush tank, such that the fan is operable to induce vitiated air from a closet bowl, and discharge freshened air into the ambient atmosphere.

2. Description of Related Art

The primary problem with prior art ventilators is that they reside only in the lower part of the gap between a closet seat and a flush tank, immediately above the upper surface of a water closet. This is the part of the gap having the greatest front to back depth, but the height available is very small, since the ventilator should not interfere with the raising of the closet seat lid. Therefore, the prior art ventilators employ deep, but low, housings. The fans are necessarily very small, there is inadequate space for a high quality air freshener, and there is not enough space to accommodate a battery for energizing the motor driven fan. This has resulted in the sealing of the closet seat to the upper surface of the water closet, in order to reduce the required volume of air needed to prevent the escape of odors from the bowl. Electric ozonizing lamps, and fragrant wafers, are taught to freshen the vitiated air induced from the bowl. And, power cords and electrical receptacles are required to energize the fans and lamps. But, cords are a nuisance, receptacles are not usually found adjacent to toilets, and ozonizing lamps and fragrant wafers are only marginally effective in deodorizing vitiated air residing in closet bowls.

One way that the problem has been solved is taught in U.S. Pat. No. 5,161,262 where the housing is greatly expanded laterally, beyond the bounds of the water closet, where there is ample room for an adequate fan, air freshener, and battery. The improvement is very effective, but has a large impact on the appearance of the toilet fixture. What is needed is a large, high performance ventilator, in which the fan and air freshener are disposed in the gap, and which can accommodate means to energize the fan motor for long periods, such as a battery.

SUMMARY

There is provided, in accordance with the invention, an improved ventilator that does not possess shortcomings of the prior art, and that satisfies the above-mentioned needs.

A version of the present invention comprises a ventilator for use with a toilet and having a motor driven fan and an air freshener interposed in seriatim between an air inlet and an air outlet in a housing disposed in a gap between a closet seat and a flush tank, the inlet disposed in communication with a closet bowl, the outlet disposed in communication with the ambient atmosphere, such that the fan is operable to induce vitiated air from the bowl, through the inlet, and discharge freshened air into the ambient atmosphere, through the outlet, wherein the improvement comprises a holding member for holding the housing on the front of the tank behind the raised seat, whereby the housing, the fan, and the air freshener can be substantially expanded in the narrow gap between the tank and the raised seat.

While the gap behind the raised seat is very narrow in modem toilets, the gap has a large height, width, area, and volume. By mounting a thin housing on the front of the flush tank, behind the raised seat, the housing can be as tall, wide, and voluminous as desired, inasmuch as the thin housing is stably supported on the tank. As a result, the fan and air freshener can also be large, and there is adequate room for a powerful battery, or other energizing means. With this arrangement, there is no need for a power cord, an electrical receptacle, a closet seat seal, ozonizing lamps, or fragrant wafers. The thin housing is relatively unobtrusive, among larger ventilators, and is mounted in an unused and out-of-the-way location, frequently hidden by the raised closet seat lid.

The housing is preferably removably mounted on the flush tank by a holding member, for example, a stick-on hook and loop fastener. And, the housing is preferably supported by the holding member so that the bottom of the housing is spaced above the upper surface of the closet bowl, so as to protect the ventilator from the frequent contamination of the upper surface, and sometimes flooding of the closet bowl. A long, thin air duct preferably slides beneath the housing, so as to provide improved communications with the closet bowl, while permitting easy removal when cleaning the water closet, or when installing or removing the housing.

BRIEF DESCRIPTION OF THE DRAWINGS

These and other features, aspects, and advantages of the present invention will become better understood with reference to the following description, appended claims, and accompanying drawings, where:

DESCRIPTION OF THE PREFERRED EMBODIMENTS

Figure 1:
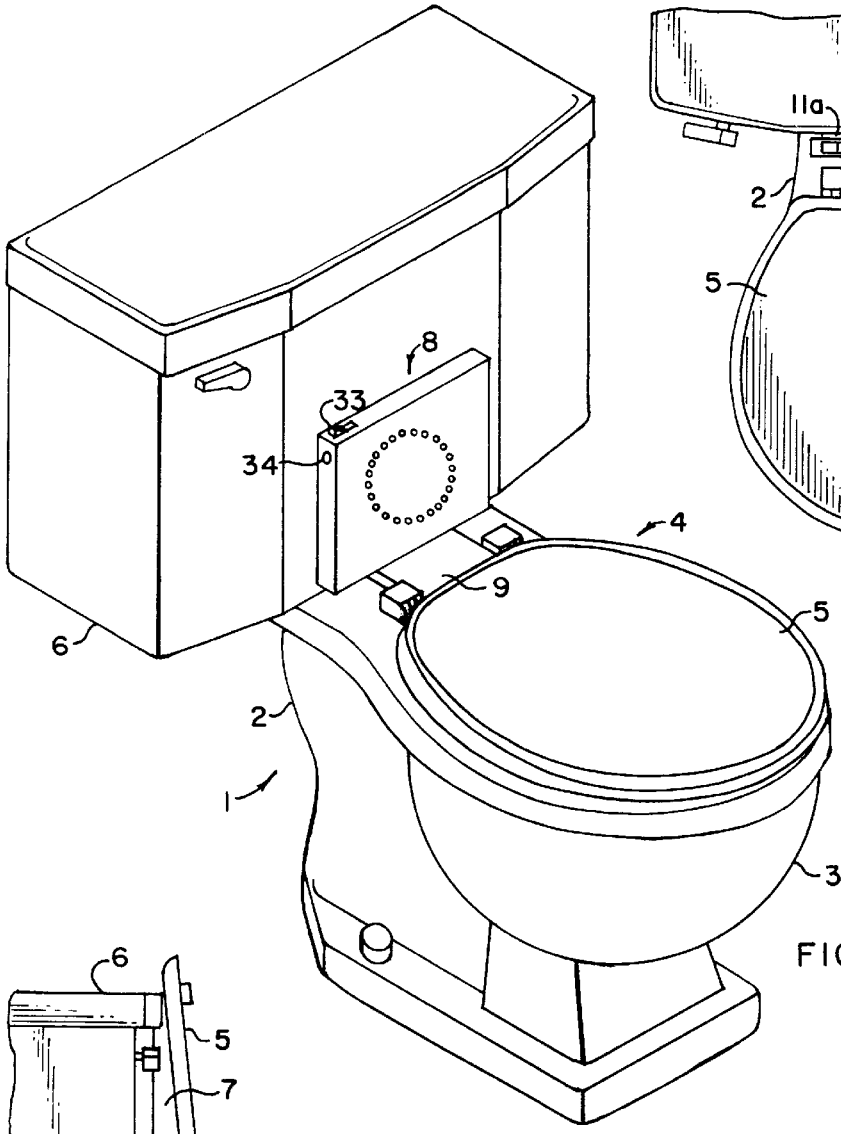
FIG. 1 is a perspective view of a version of the ventilator, in place upon a typical toilet fixture.
Figure 3:
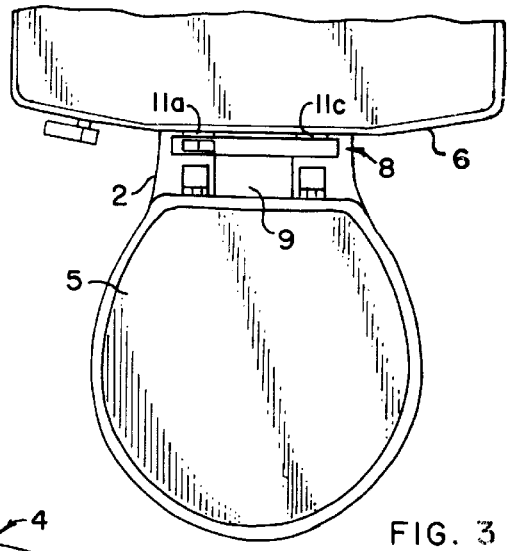
FIG. 3 is a top view, partially cut away, of the structure of FIG. 1.
Figure 2:
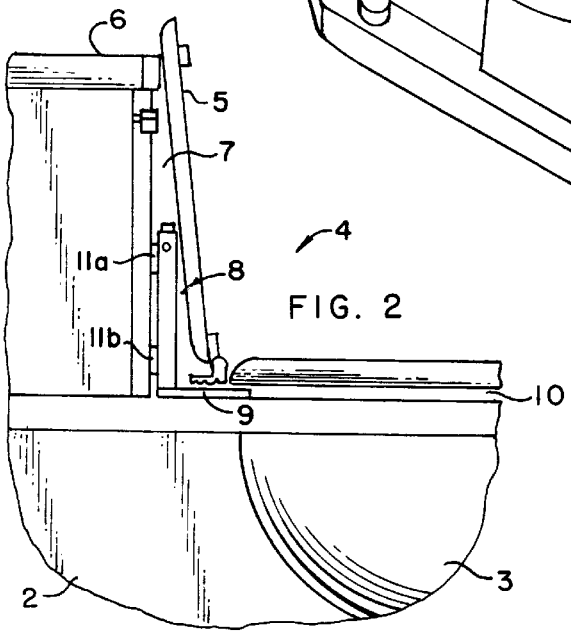
FIG. 2 is a fragmentary side view of the structure of FIG. 1, and having the closet hinge cut away to better reveal the ventilator installation.

With reference to the drawings, and particularly to FIGS. 1, 2, and 3, a toilet 1 includes a water closet 2 having a closet bowl 3, a closet seat 4 having a lid 5 that can be raised and lowered, and a flush tank 6. There is a narrow gap 7 between the raised lid 5 and the tank 6, FIG. 2.

A thin housing 8 resides in the narrow gap 7, alongside the raised lid 5, FIG. 2. Owing to the large height, width, area and volume of the gap 7, the housing 8 can be large. However, the depth of the housing 8 must be kept thin, depending on the range of toilets 1 to be accommodated.

An air duct 9 communicates with the bowl 3 through a clearance 10 between the upper surface of the water closet 2 and the bottom of the seat 4. For best effectiveness, the air duct 9 should extend under the seat 4, all the way to the rim of the bowl 3.

The housing 8 is attached to the front of the flush tank 6 by a holding member, such as strips of stick-on hook and loop fastener material, shown at 11*a*–11*c*. A great many other devices are available for use as holding members, including adhesive, magnetic, and mechanical. The requirement is that the holding member have a part for attaching to the tank, a part for attaching to the housing, and a part connecting therebetween.

Figure 5:
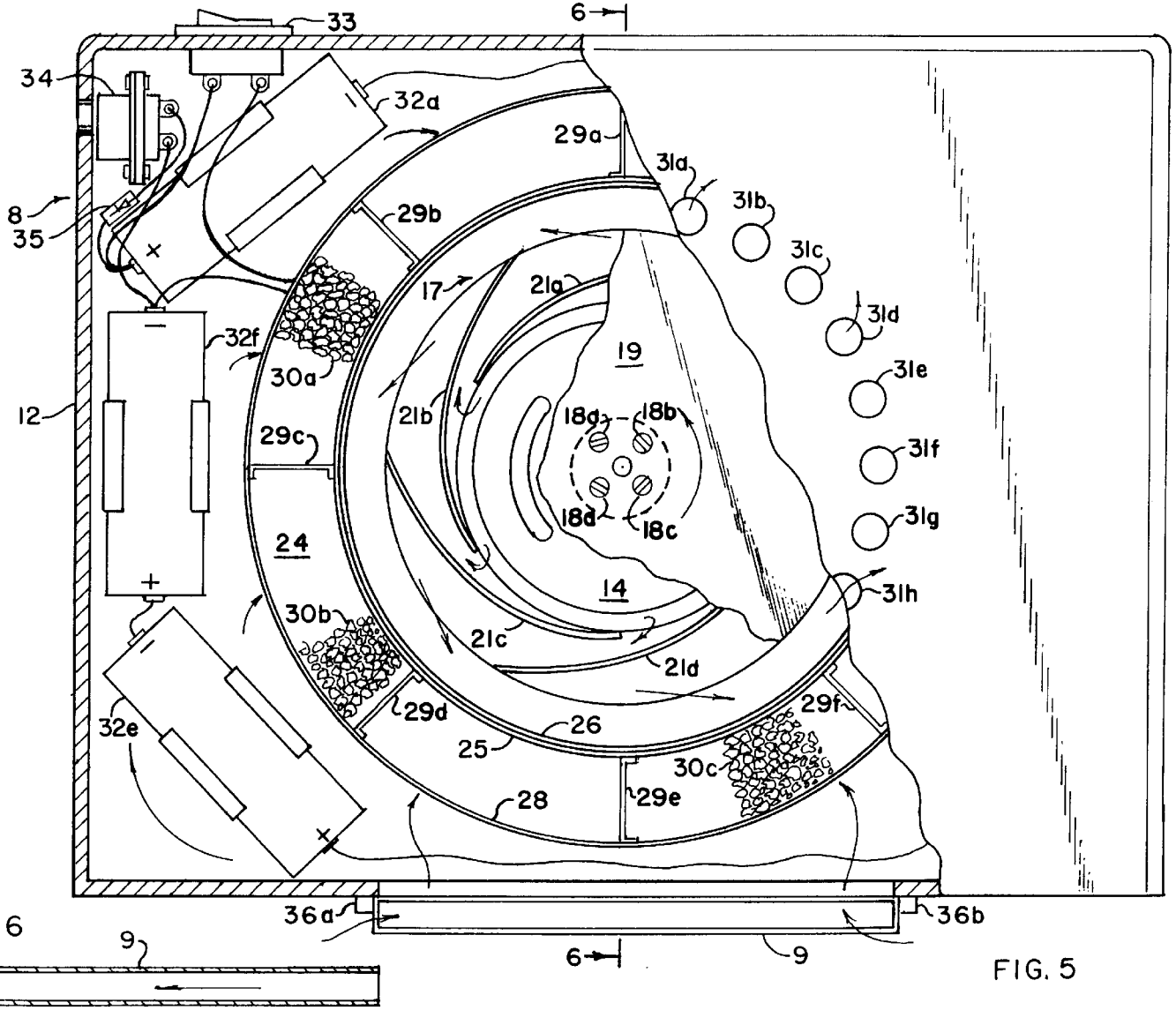
FIG. 5 is a front view of a version of the ventilator, partially cut away.
Figure 6:
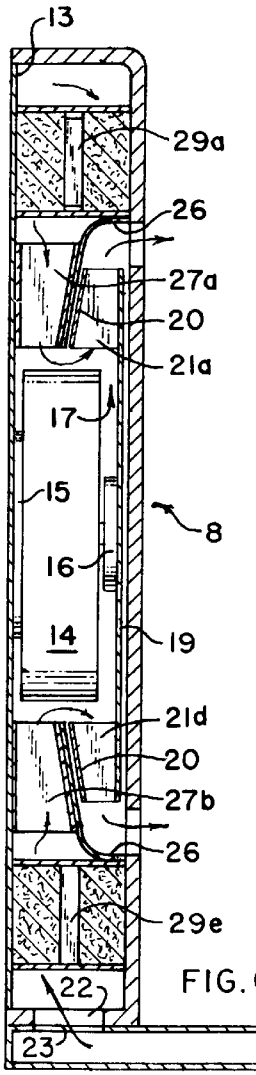
FIG. 6 is a cross-sectional side view, taken along line 6—6 of FIG. 5.

Details of the housing 8 are portrayed in FIGS. 5 and 6. The housing 8 is preferably comprised of a molded cover 12, and a rear cover plate 13 attached to the cover 12 by a plurality of screws (not shown). A fan motor 14 is attached to the cover plate 13 by at least one preferably rubber motor mount 15 bonded to the cover plate 13 and the fan motor 14, FIG. 6. A hub 16 is pressed onto the shaft of the motor 14, and a fan wheel 17 is screwed to the hub 16 by a plurality of screws 18*a*–18*d*. The fan wheel 17 is preferably comprised of a thin aluminum back plate 19, a thin aluminum shroud 20, and a plurality of thin aluminum vanes, such as 21*a*–21*d*, attached to the back plate 19 and the shroud 20. It is important that the fan wheel 17 be well balanced.

An air inlet 22 is provided in the bottom of the housing 8. A mating port 23 is provided in the air duct 9, FIG. 6. The bottom of the housing 8 can be supported above the upper surface of the water closet 2, by the holding members 11*a*–11*c*, so that there is an air space between the bottom of the housing 8 and the upper surface of the water closet 2. The air duct 9 can then removably reside in the air space, centered by the bosses 36*a* and 36*b* on the cover 12. When the motor 14 is started, the fan wheel 17 rotates in the direction of an arrow near the hub 16, FIG. 5, the pressure in the housing 8 is reduced by the fan wheel 17, and vitiated air is induced from the bowl 3, through the air duct 9 into the housing 8. The air flow through the housing 8 is represented by arrows.

An annular activated carbon filter bed 24 removes odor molecules from the vitiated air, and also removes dust, lint, dirt, and the like, so as to keep the fan motor 14 and the fan wheel 17 clean. The filter bed 24 is a very effective air freshener, and advantageously requires no energy source. The filter bed 24 is defined by the inner annular perforated plate 25 attached to the fan housing 26, which is attached to the cover plate 13 by a plurality of inlet guide vanes, such as 27*a*–27*b*. The filter bed 24 is further defined by the outer perforated plate 28, attached to the inner perforated plate 25 by a plurality of stiffeners, such as 29*a*–29*f*.

Vitiated air enters the filter bed 24 through the outer perforated plate 28, and freshened air exits through the inner perforated plate 25. The face area and thickness of the filter bed 24 determine the contact time of the vitiated air with the filter bed 24, which should be at least 0.05 second. A filling hole (not shown) is provided in the cover plate 13 for filling the filter bed 24 with activated carbon granules, such as portrayed at 30*a*–30*c*. The filling hole is covered by a piece of tape (not shown).

Freshened air from the inner perforated plate 28 is directed into the eye of the fan wheel 17 by a plurality of guide vanes, such as 27*a*–27*b*. Freshened air from the fan wheel 17 is directed by the fan housing 26 into a plurality of outlet holes, such as 31*a*–31*h*, FIG. 5. Applicant prefers that the fan wheel 17 deliver about 4 cubic feet of air per minute, although 2 cubic feet of air will work. It is important that no vitiated air escape the bowl 3 when a small child occupies the closet seat 4, leaving a large area of the seat 4 uncovered. The air pressure rise across the fan wheel 17 varies greatly with the exact design of the housing 8 and the air duct 9, but is frequently equivalent to a water column of about 0.5 inch.

Figure 4:
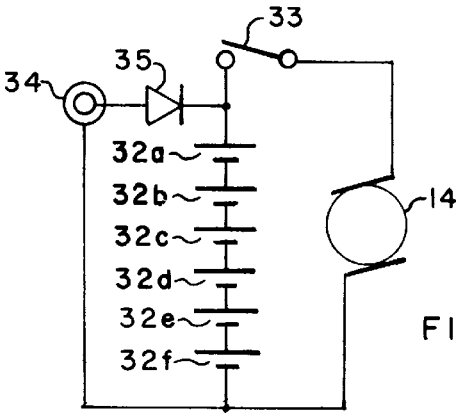
FIG. 4 is a diagrammatic view of an electrical circuit suitable for the ventilator.

FIG. 4 portrays a suitable wiring diagram for the ventilator. A plurality of rechargeable batteries 32*a*–32*f*, preferably six, energize the fan motor 14, through the switch 33. The batteries 32*a*–32*f* are charged through the connector 34 and a rectifier 35. The rectifier 35 prevents damage to the wiring in the housing 8 if the connector 34 or the battery charger (not shown) are shorted.

Although a preferred version of the present invention has been described, variations and modifications will be apparent to those skilled in the art, and the spirit and scope of the invention is by no means restricted to what is described above. The above-described version is, therefore, intended to be merely exemplary, and all such variations and modifications are intended to be included within the scope of the invention as defined in the appended claims.

What is claimed is:

1. In a ventilator for use with a water closet and having a motor driven fan and an air freshener interposed in seriatim between an air inlet and an air outlet in a housing disposed in a gap between a closet seat and a flush tank, the inlet disposed in communication with a closet bowl, the outlet disposed in communication with the ambient atmosphere, such that the fan is operable to induce vitiated air from the bowl, through the inlet, and discharge freshened air into the ambient atmosphere, through the outlet, wherein the improvement comprises a holding member for holding the housing on the front of the tank behind the raised seat, the holding member comprising a part for attaching to the tank, a part for attaching to the housing, and a part connecting therebetween, whereby the housing, the fan, and the air freshener can be substantially expanded in the narrow gap between the tank and the raised seat.

2. A ventilator according to claim 1, further including means, supported by the housing, for energizing the motor driven fan.

3. A ventilator according to claim 1 wherein the holding member comprises a hook and loop fastener.

4. A ventilator according to claim 1 wherein the holding member supports the housing such that there is an air space between the bottom of the housing and the upper surface of the water closet, whereby the housing resides above the frequently contaminated and sometimes flooded upper surface.

5. A ventilator according to claim 4 further including a thin air duct for disposition in said air space, in communication with the inlet, and extending to a predetermined location adjacent the bowl.

* * * * *